United States Patent [19]

Tellis et al.

[11] Patent Number: 4,952,745

[45] Date of Patent: Aug. 28, 1990

[54] CONTROL ACR PRODUCT YIELDS BY ADJUSTMENT OF SEVERITY VARIABLES

[75] Inventors: Cyril Tellis, Charleston, W. Va.; Saburo Hori, Iwaki, Japan; David Milks, Charleston, W. Va.

[73] Assignee: Union Carbide Chemicals and Plastics Company Inc., Danbury, Conn.

[21] Appl. No.: 190,114

[22] Filed: May 4, 1988

Related U.S. Application Data

[63] Continuation of Ser. No. 547,001, Oct. 31, 1983, abandoned.

[51] Int. Cl.[5] ..... C07C 4/04

[52] U.S. Cl. ..... 585/648; 208/106; 208/130; 585/615; 585/649; 585/650; 585/652

[58] Field of Search ..... 585/648, 649, 650, 652; 208/106, 130

[56] References Cited

U.S. PATENT DOCUMENTS

| | | | |
|---|---|---|---|
| 3,419,632 | 12/1968 | Sogawa et al. | 585/539 |
| 4,136,015 | 1/1979 | Kamm et al. | 208/130 |
| 4,142,963 | 3/1979 | Kearns | 208/129 |

OTHER PUBLICATIONS

Khavarian, Thesis for Master Degree in Chemical Engineering, West Virginia College, "Olefins Production by Crude Oil Cracking", Apr. 1984, pp. 1–22.

Kearn et al., Symposium on Recent Advance in the Production and Utilization of Light Olefins, 175th National Meeting, Mar. 12–17, 1978, "Development of Scaling Methods for a Crude Oil Chacking Reactor".

*Primary Examiner*—Asok Pal

*Attorney, Agent, or Firm*—Norman L. Balmer

[57] ABSTRACT

Improved operation of the ACR process is achieved by regulating the reactions within a small area in the combustion feedstock mixing zone, "Scorch Zone", by the addition of steam or other fluid such as ethane at the point of feed injection.

2 Claims, 2 Drawing Sheets

EFFECT OF INJECTOR SHROUD STEAM AND HEAT CARRIER TEMPERATURE ON ACR GAS YIELDS (CONTINUOUS REACTOR RESULTS)

■ ▲ ● Data with injector shroud steam

□ △ ○ Data without injector shroud steam

EFFECT OF INJECTOR SHROUD STEAM AND HEAT CARRIER TEMPERATURE ON ACR GAS YIELDS (CONTINUOUS REACTOR RESULTS)

CONTROL ACR PRODUCT YIELDS BY ADJUSTMENT OF SEVERITY VARIABLES

This application is a continuation of prior U.S. application Ser. No. 547,001 filing date Oct. 31, 1983, now abandoned.

TECHNICAL FIELD

This invention relates to a method which will enhance the practice of the Advanced Cracking Reactor (ACR) process. Hydrocarbon feed is introduced into a high temperature heat carrier such that a modification of the yield spectrum is achieved by the addition of steam or other fluid such as hydrogen or ethane at the point of feed injection. The amount and/or temperature of the added species can be used to control the product distribution.

DISCUSSION OF PRIOR ART

The Advanced Cracking Reactor (ACR) process is characterized by Khavarian, thesis for masters degree in chemical engineering, West Virginia College of Graduate Studies, entitled: "Olefins Production by Crude Oil Cracking", Apr. 1977, as offering distinct advantages: one being the flexibility in the selection of feedstocks, and another being, the ability to alter product compositions by changing process variables. Hosoi and Keister, Chemical Engineering Progress, Volume 71, Number 11, Nov. 1975, Pages 63–67 discuss many of the advantages of ACR process. Davis and Keister, in a paper presented before the Division of Petroleum Chemistry, Inc., of the American Chemical Society at the Philadelphia meeting, Apr. 6–11, 1975 entitled "THE ADVANCED CRACKING REACTOR (ACR) A PROCESS FOR CRACKING HYDROCARBON LIQUIDS AT SHORT RESIDENCE TIMES, HIGH TEMPERATURES AND LOW PARTIAL PRESSURES," address the issue of severity in the production of products and the flexibility which is achieved in the use of the ACR process to make a variety of product compositions.

Kearns, Milks, and Kamm (Kearns, et al.) in a paper presented to the Symposium on Recent Advances in the Production and Utilization of Light Olefins, Division of Petroleum Chemistry of the American Chemical Society, at the 175th National Meeting, Anaheim, California, Mar. 12–17, 1978, "Development of Scaling Methods for a Crude Oil Cracking Reactor Using Short Duration Test Techniques", give a thorough analysis of the ACR process. The same Kearns, et al. article, at pages 108 through 128, in a text entitled, "Thermal Hydrocarbon Chemistry", Oblad, et al., editors, of the Advances in Chemistry Series 183, published by the American Chemical Society, Washington, D.C., 1979, characterizes the extreme flexibility with regard to feedstock and product yields combined with intrinsically high chemical yields that one can achieve in the practice of an ACR to produce ethylene.

Kearns et al. give information on various critical scale-up conditions for practicing the ACR process and speak in terms of process variables which impact on the operation of the ACR. Of interest in respect to the instant invention is a statement at page 127 of the article wherein the authors indicate that the "Oil Injection Control Volume" is the "region of the highest process temperatures which tend to generate high $C_2H_2$ yields."

The patent literature abounds in general descriptions of the ACR process and various embodiments of it. Illustrative of such patent literature are U.S. Pat. Nos. 3,408,417, 3,419,632, 3,674,679, 3,795,713, 3,855,339, 4,134,824, 4,136,015, 4,142,963, 4,150,716, 4,240,898, 4,264,435, and 4,321,131.

As is evidenced by the substantial prior art, much is already known about the ACR process. It is a process which combusts fuels in a combustion zone or chamber and regulates the temperature of the hot combustion gas stream with addition of steam. The regulated (or moderated) hot combustion gas (containing steam) is thereafter mixed with a fine droplet hydrocarbon feedstock stream. This hydrocarbon feedstock stream can be surrounded by a steam shroud which imparts additional momentum to the feedstock spray to achieve better intermixture with the hot combustion gas/steam stream. The mixture flows to the reaction zone where the desired cracking of the feedstock occurs. Refinement of this process has led to an understanding of the manner in which the process should be practiced in order to optimize the product distribution obtainable.

As pointed out in the Davis and Keister paper, "severity" is a factor which dictates the product mix. Severity is controllable in broad general terms through manipulation of reactor operating variables and it can be adjusted to optimize a certain product distribution. It has been determined however, that there exist regions or areas of higher reaction severity within the confines of the ACR process wherein a cracking reaction occurs which can impact significantly upon the product distribution. In these zones, ultra-high cracking severity occurs and products such as methane, acetylene, hydrogen, and their precursors, predominate and contribute a disproportionately large amount of such products in the eventual ACR product mix.

The aforementioned zones of ultra-high reaction severity occur where the combustion gas/steam stream from the combustion zone first makes contact with the plume of the injected hydrocarbon feedstock spray. At pages 116 through 118 of the Kearns et al. article in "Thermal Hydrocarbon Chemistry", supra, the injected hydrocarbon feedstock is sprayed countercurrently into the interior of the chamber downstream of the combustion zone and forms an arc-shaped stream or plume which converges with a combustion gas/steam stream being rectilinearly projected toward the ACR throat into the ACR diffuser/reactor.

The spatial zones of ultra-high reaction severity are termed, for the purposes of the invention, as "Scorch Zone". This means that in these zones there exist conditions wherein hydrocarbons are maximally cracked to produce an inordinate quantity of lower-boiling species and gaseous products such as methane, acetylene, hydrogen, and the like. This occurs because the outer boundary of the hydrocarbon spray plume is not protected from the extremely high temperatures of the combustion gas/steam stream. Subsequent mixing of hydrocarbon feed with the combustion gas/steam stream therefore causes a temperature equilibration to occur which serves to moderate temperature effects within the hydrocarbon feed. However, at the outer edge of the plume which first contacts the combustion gas/steam stream, no temperature moderation effects are available; consequently, the outer portions of the plume receive the full effect of the extreme temperatures of the combustion gas/steam stream and consequently, there occurs a maximum degree of cracking in such zones. Such cracking is deemed undesirable for the proper practice of the ACR process.

In the past, to mitigate the reactions occurring in such zones, major changes were made to various process variables which dramatically altered the composition of the ACR product mix. To change what was being produced in such zones required changes in major process variables such as burner temperature and dilution mass flow rate. This adversely affects process economics and the composition of the product mix.

There is herein described a process which allows one to minimize the effects which are occurring within the Scorch Zones of the ACR in order to enhance the making of the desired reaction products of the ACR process. By knowing where the Scorch Zones exist and what occurs in the zones, one can vary the yield of products obtained in the ACR process without undertaking major process changes. Consequently, a minimal change in the operation of the ACR process can impact significantly on the kinds of products and their concentrations, thereby minimizing a significant negative effect on the overall economics of the process.

SUMMARY OF THE INVENTION

The process of this invention involves practicing the ACR process by moderating the conditions of the Scorch Zone by adjusting certain variables, within the hereinafter defined Scorch Zone Variables, to produce a desired ACR product composition. Generally, "Scorching Zones" are the spatial zones within the Advanced Cracking Reactor at which the plume(s) of the spray of hydrocarbon feedstock first contact the hot combustion gas/steam.

The process of this invention is an improvement in the ACR process and involves, inter alia, the following conventional ACR process steps within an Advanced Cracking Reactor (ACR):

(a) the formation of a combustion gas/steam stream having a temperature of 1200° C. to about 2400° C.;

(b) mixing of said stream (as defined in (a) above) with a countercurrent feed stream, in the form of a spray of atomized droplets of hydrocarbon feedstock shrouded by a stream or streams of steam or other fluid;

(c) passing the admixture of (b) above to the throated portion of the reactor to achieve a sonic velocity;

(d) passing the feed from (c) above to an expanding diffuser/reaction zone wherein (i) the feed accelerates to supersonic velocity then undergoes a shock and decelerates to subsonic velocity and (ii) the temperature is from 600° C. to 1400° C.; thereby cracking the feedstock into a stream in which ethylene is a significant product; and (e) quenching the products from (d) above to stop the cracking reaction.

The improvement of this invention involves a modification of the operation of (b) above, hereinafter termed the "feedstock mixing step".

The improvement in the ACR process involves moderating the conditions of the Scorch Zone in the feedstock mixing step. The Scorch Zones are more readily identified as those zones wherein the initial cracking of feedstock occurs to form such hydrocarbons as acetylene, methane, hydrogen, and their precursors. These exist where the plumes of the hydrocarbon spray first merge into contact with the combustion gases being fed through the throat to the cracking diffuser/reactor portion of the ACR. To control what occurs in the Scorch Zone which in turn controls the concentration of products that are produced, one can select a number of process variables, which are hereinafter defined as the Scorch Zone variables.

The Scorch Zone variables are defined as one or more of the following: (1) adjustment in the weight ratio of the shroud fluid to the hydrocarbon feedstock; (2) the temperature of the shroud fluid; (3) the composition of the shroud fluid; (4) the method of feedstock introduction; (5) the feedstock flashing behavior; (6) feedstock temperature; (7) the burner process variables, such as the mass rate of the combustion gas products/steam stream to the mass rate of the hydrocarbon feedstock and the temperature and the composition of the combustion gas/steam stream.

DETAILED DISCUSSION OF THE INVENTION

Figure 1:
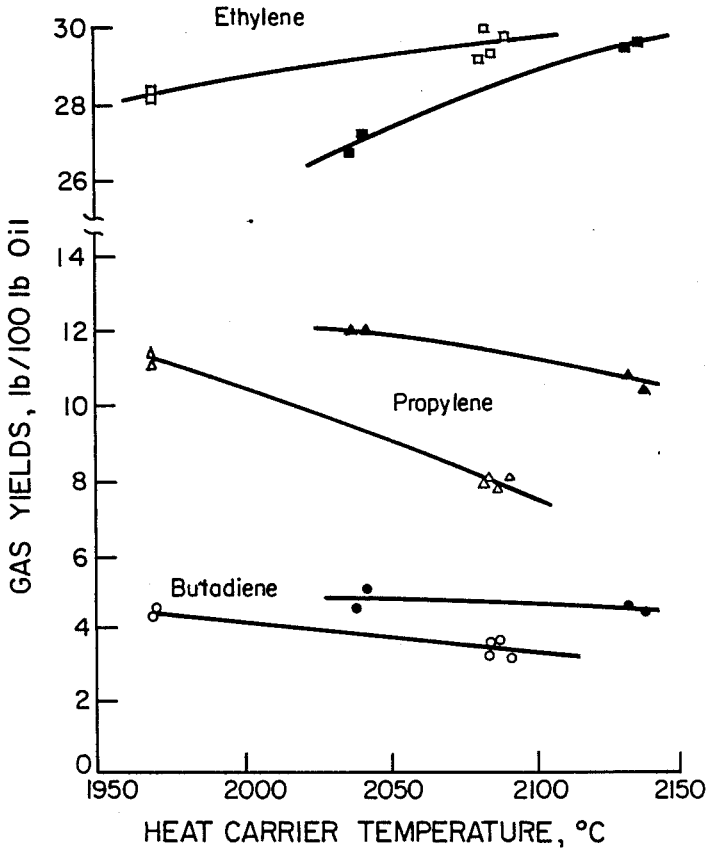
FIG. 1 and FIG. 2 are graphs which illustrate the effect of injector shroud steam and heat carrier temperature on ACR gas yields utilizing a continuous reactor.

As pointed out previously, this invention involves the modification of the ACR process by changing the conditions which exist within the Scorch Zone to decrease the products therein formed such as acetylene, methane, hydrogen, and their precursors. The success of the process of this invention is reflected by the concurrent reduction in the presence of those products in the product stream which is removed from the diffuser/cracking reactor portion of the ACR.

As discussed above, small severe reaction zones exist within the area where the combustion gas/steam stream mixes with the hydrocarbon feedstock and can have a significant impact on the yield of certain products of the ACR process. With this knowledge, one can deal directly with what is occurring within those zones in order to change or control the yield of the product mix of the ACR process. Consequently, the amount of propylene and butenes that are obtained from the ACR process can be increased with minimum reduction in the ethylene yield, simply by moderating the production within the Scorch Zone of acetylene, methane, hydrogen, and their precursors. The number of variables which one can utilize to control what is occurring within the Scorch Zone are so diverse, but it can be determined experimentally which variables can be modified to achieve the improvements, in accordance with the invention.

In order to more effectively define this invention, recourse is made to the term "Scorch Zone Variables" to designate the choices of process modifications that are available for moderating the undesirable effects of scorching of a small portion of the hydrocarbon feed produced. Scorching, as defined herein, means the subjection of the hydrocarbon feed to intense heat. When the hydrocarbon feedstock is subjected to such intense heat (scorching), a large part of it is converted to acetylene, methane, hydrogen and their precursors.

The most effective utilization of the ACR involves carrying out the process as set forth in U.S. Pat. No. 4,136,015. Therein described is the improved operation of the ACR process by the atomization of the liquid petroleum feedstock into the stream of hot combustion gas/steam in a chamber in which the gas/vapor flow is maintained at subsonic velocity. Thereafter, the complete mixing and vaporization is effected in a constricted throat zone wherein the combined stream exits at sonic velocity. The stream is thereafter passed through a velocity acceleration diffuser/reactor zone and achieves supersonic velocity flows. The stream then passes through a shock region produced by the cross-sectional expansion of the diffuser/reactor zone and this reduces the velocity to subsonic. Additional cracking occurs in the reaction zone before quenching.

As pointed out in the patent, one of the methods of mixing the hot combustion products with the feedstock is to effect an atomized form of the feedstock within a mixing zone once combustion is achieved. This mixing of the feedstock and combustion products is enhanced by using a steam shroud envelope about the hydrocarbon feed. Such a shroud is described in U.S. Pat. No. 4,142,963. The purpose for which the shroud is employed is to enhance the overall penetration of the hydrocarbon feed into the mixing area wherein admixture with the combustion gas/steam stream is effected.

In the operation of the ACR, the hydrocarbon feed is typically sprayed from a small constriction under pressure into the mixing zone where the temperature is extremely high, viz 1200° C.–2400° C. When this occurs, the spray of hydrocarbon being emitted is discretely atomized and projected forward towards the central axis of the mixing zone. As the stream is projected forward, the upward and outermost extremes of the spray plume make first contact with the combustion product gases and this generates the aforementioned Scorch Zones. The Scorch Zones may not exist in any one particular area but in a number of areas within the mixing zone. The kinds and locations of them are largely determined by the nature of the spray pattern of the hydrocarbon feed plume within the interior of the mixing zone. If the hydrocarbon feed spray plumes are absolutely uniform as emitted from the ports of their introduction, then, of course, the location of the Scorch Zones are more accurately determinable.

To alleviate the severe cracking of small increments of the hydrocarbon feedstock which occurs within the mixing zone when the outer extremities of the spray plume of the hydrocarbon feedstock first contacts the combustion gas/steam mixture, a number of process factors are available. For example, one can adjust the weight ratio of the shroud fluid flow to that of hydrocarbon feedstock. By introducing a greater concentration of shroud fluid in the region of the outer extremities of the spray plume, the temperatures at such extremities can be moderated and thereby reduced, and to some extent, the adverse cracking reaction moderated.

Another method by which the mixture of the scorch zone can be controlled is through the temperature of the shroud fluid. If the temperature of the shroud fluid is reduced by a value which would reduce the temperature in the zones where the undesired cracking occurs, the heat which would normally be utilized to effect the cracking reaction would instead be partially utilized to bring the temperature of the gases in the mixing zone to the desired level.

Another variable for controlling the problems which occur in the Scorch Zone is the composition of the shroud fluid. Some potential shroud fluids, such as steam, are essentially chemically inert, and only have thermal effects on the reaction. However, other possible shroud fluids, particularly hydrogen or those compounds rich in hydrogen, can participate in the cracking reactions and have a beneficial effect on the yield pattern. Hydrogen and methane would be particularly effective in this use. However, other compounds which are gaseous at the injection temperature and are high in hydrogen, such as ethane and propane, could also be used. In addition to moderating the severe cracking in the Scorch Zone, compounds such as ethane and propane will also crack to yield useful products.

A number of methods of feedstock introduction can be utilized to moderate the conditions which exist in the outer extremities of the plume of the hydrocarbon feedstock spray. The feedstock should be injected in such a way as to give quick and intimate mixing with the gaseous combustion products. In this way the mixture reaches thermal equilibrium quickly, and the extent of the Scorch Zone is minimized. This is accomplished by atomizing the feed to extremely small droplets, which have a high surface area, so that they will mix and vaporize quickly. Such techniques are well known in the prior art. In any case, the feed nozzles should be placed and oriented, and the feed pressure adjusted, to give well-defined feedstock plumes which will penetrate well into the center of the flowing stream of hot combustion products.

The flashing behavior of the feedstock will also affect the conditions of the Scorch Zone, because a feedstock which flashes, or evaporates quickly, will absorb the heat of vaporization and mix quickly with the gaseous combustion products. Thus, feedstock which is evaporated quickly will minimize the extent of the Scorch Zone.

Flashing behavior can be controlled to some degree. Feedstocks which flash at a low temperature are preferred. Where it is not practical to use such feedstocks, flashing may sometimes be induced by preheating the feedstock above its normal boiling point at a high pressure, so that it remains in a liquid state; when the feed is injected through the nozzles, the pressure drops and the feed will flash. If the feed has a wide range of boiling points, only the lighter fractions may flash. However, this is still useful since flashing aids in the breakup and atomization of the feedstock droplets, and promotes good mixing with the gaseous combustion products. If the feedstock consists of all heavy components, so that flashing cannot be induced by preheating, small amounts of a lighter component may be blended with the feedstock, so that this lighter component will flash upon injection. This will improve the atomization and mixing of the feedstock, and thus reduce the extent of the Scorch Zone.

In contrast to whole distillate, certain heavy feedstocks, such as heavy vacuum gas oil, do not contain any components which would flash at reactor conditions, even after being preheated to 400° C. at the feed pressure. In this case, it might be desirable to mix the feedstock with a small amount of a light component to cause flashing and increase atomization. For example, a heavy vacuum gas oil could be mixed with about 10 to 20 weight percent naphtha or atmospheric gas oil.

Other factors will have an effect on the extent and conditions of the Scorch Zone. The gross reaction conditions can be adjusted to reduce the effect of the scorch zone. However, economically it is much less desirable to adjust the major, overall reactor conditions, rather than the local conditions as described above.

For example, the temperature of the gaseous combustion products can be reduced to lower the temperature in the Scorch Zone. However, this will directly reduce the net energy input to the reactor, and thus will lower the yields obtained from the feedstock. Alternatively, the mass ratio of combustion products to feedstock can be increased, to increase dilution and lower the partial pressure of the feedstock. However, this requires added fuel, oxygen and steam to be fed to the combustion chamber. The composition of the gaseous combustion products may also be varied, for example by feeding an excess of hydrogen to the burner, thus increasing the hydrogen content in the scorch zone. However, this will also increase the fuel costs.

An important advantage of this invention is that local changes in the critical Scorch Zone have a strong and disproportionate effect on the final yields, without incurring major costs due to changes in the overall operating variables. By injecting the feed according to the principles outlined above, the extent and effect of the Scorch Zone are minimized; judicious use of small amounts of shroud fluid will then have a strong, positive effect on the yield pattern by further alleviating the effects of the Scorch Zone.

The actual design of the apparatus for injecting the shroud fluid is not critical. The concentric annular opening is simple and convenient to use, but other methods are possible. The only requirement is that the shroud fluid should be injected in such a way that a substantial part of it flows to a region where it can moderate the results of the scorch zone.

In addition to steam, other fluids may be used in the shroud, such as ethane. Ethane is one of the products resulting from the cracking of the feedstock. This ethane is separated and preheated to about the temperature of high pressure steam, then injected through the annular openings around the feed nozzles, along with the shroud steam. Much of the ethane cracks to give primarily ethylene, with some hydrogen and other products. The injection of the ethane further moderates the effect of the Scorch Zone, both through thermal effects, and through the chemical participation of the ethane and hydrogen in the reactions occurring in the Scorch Zone. This also has the benefit that the byproduct ethane is effectively cracked to useful products. If desired, the hydrogen, methane and certain other products of the cracking process can also be included in the shroud fluid in this way.

EXAMPLES

EXAMPLE 1

Table I indicates the experimental data obtained while utilizing a continuous reactor. The continuous reactor is approximately one-four hundredth the size of a commercial reactor, and produces approximately 250,000 lbs./yr. of ethylene.

Two major variables were screened in the continuous reactor, with and without the addition of injector shroud steam. The results of the experiments were adjusted slightly for the purposes of comparison to a common set of variables using available yield regression models as follows:

Steam dilution 8.74 lb. moles/100 lb. oil (without injector shroud steam)

9.56 lb. moles/100 lb. oil (with injector shroud steam)

Feed Preheat Temperature 375° C.

The reactor pressure (40 psig) and the amount of excess fuel (approximately 10%) were kept constant. The results of the experiments utilizing the continuous reactor which show the effect of injector shroud steam on ACR gas yields are shown in Table I.

A comparison of the data in Table I indicates that injector shroud steam produces selectivity shifts in the yields of gaseous components by moderating the reaction severity. High shroud steam results in lower methane and acetylene yields with higher propylene and butene yields.

Figure 2:
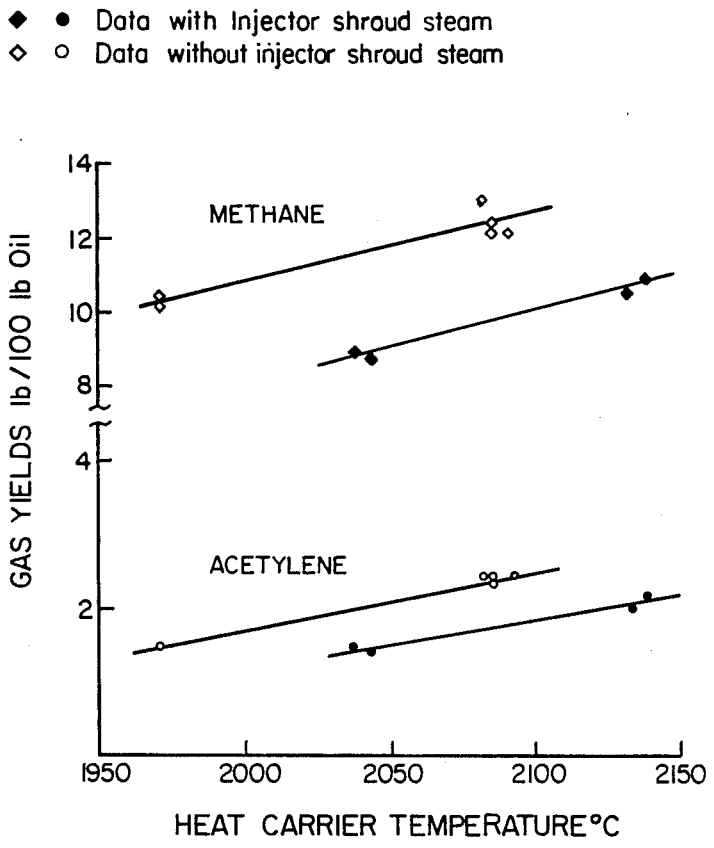

FIGS. 1 and 2 represent the yields of selected components as a function of the heat carrier temperature. FIG. 1 shows that the ethylene yield is approximately 1 pound higher in the absence of injector shroud steam at less than 2100° C. (lower severities). FIG. 1 further illustrates that in the absence of injector shroud steam, the propylene and butadiene yields are significantly lower over the range of heat carrier temperature studied.

FIG. 2 similarly illustrates that without injector shroud steam the methane and acetylene yields are significantly higher.

TABLE I

Effect of Injector Shroud Steam on ACR Gas Yields
Continuous Reactor Results

| | RUN NO. | | | | | | | |
|---|---|---|---|---|---|---|---|---|
| Operating Conditions: | 1 | 2 | 3 | 4 | 5 | 6 | 7 | 8 |
| Reactor Pressure (psig) | 40.0 | 40.0 | 40.4 | 40.3 | 40.0 | 40.0 | 40.2 | 40.0 |
| Combustion Pressure.(psig) | 57.0 | 57.0 | 58.5 | 58.5 | 52.5 | 52.5 | 53.6 | 53.7 |
| Total Diluent Ratio: | | | | | | | | |
| lb./lb. oil | 1.67 | 1.66 | 1.68 | 1.70 | 1.54 | 1.54 | 1.52 | 1.53 |
| lb. mol/100 lb. oil | 9.56 | 9.56 | 9.56 | 9.5 | 8.74 | 8.74 | 8.74 | 8.74 |
| Injector Shroud Steam: | 0.15 | 0.14 | 0.15 | 0.15 | 0.0 | 0.0 | 0.0 | 0.0 |
| lb. mol/100 lb. oil | 0.82 | 0.84 | 0.75 | 0.63 | 0.0 | 0.0 | 0.0 | 0.0 |
| Excess Fuel to ACR Burner, Mol % | 10.5 | 10.4 | 9.6 | 9.5 | 10.2 | 10.5 | 10.3 | 9.8 |
| Diluent (Heat Carrier) Temp., °C. | 2037 | 2043 | 2137 | 2133 | 1970 | 1969 | 2083 | 2091 |
| Feed Temperature, °C. | 375 | 375 | 375 | 375 | 375 | 375 | 375 | 375 |
| Methane/Propylene, mol/mol | 1.97 | 1.94 | 2.64 | 2.61 | 2.48 | 2.40 | 4.36 | 4.04 |
| Reactor Residence Time, milliseconds | 18.7 | 18.7 | 17.9 | 17.9 | 18.9 | 18.6 | 18.5 | 18.4 |
| Gas Yields, lb./100 lb. feed | | | | | | | | |
| Hydrogen | 1.34 | 1.35 | 1.56 | 1.53 | 1.53 | 1.59 | 1.51 | 1.55 |
| Methane | 8.9 | 8.79 | 10.91 | 10.6 | 10.35 | 10.3 | 12.97 | 12.22 |
| Acetylene | 1.45 | 1.44 | 2.15 | 1.97 | 1.51 | 1.51 | 2.37 | 2.4 |
| Ethylene | 26.66 | 27.16 | 29.5 | 29.38 | 28.11 | 28.38 | 29.17 | 29.74 |
| Propylene | 11.87 | 11.87 | 10.05 | 10.68 | 10.95 | 11.28 | 7.80 | 7.93 |
| Butene | 3.61 | 3.95 | 2.07 | 2.20 | 2.28 | 2.31 | .74 | 0.64 |

TABLE I-continued

| Effect of Injector Shroud Steam on ACR Gas Yields Continuous Reactor Results | | | | | | | | |
|---|---|---|---|---|---|---|---|---|
| | RUN NO. | | | | | | | |
| Operating Conditions: | 1 | 2 | 3 | 4 | 5 | 6 | 7 | 8 |
| Butadiene | 4.51 | 4.96 | 4.27 | 4.37 | 4.26 | 4.46 | 3.12 | 3.04 |

EXAMPLE 2

An ACR demonstration unit, having an ethylene capacity of approximately 5,000,000 lbs./yr. was run (See Run 1, Table II) with a naphtha feedstock flow rate of about 1950 lb./hr. through four injectors. The injectors which have concentric annuli, have a total steam flow rate of approximately 200 lb./hr. The yield pattern obtained is illustrated in Table II.

During Run 2 (See Table II), ethane was added to the injector annulus flows at a total rate of 150 lb./hr. The combined ethane plus naphtha cracking feedstock flow rate was set at approximately 1950 lb./hr. as in the previous run. The injector annulus steam flow and all other operating variables remained constant. The yield pattern obtained is illustrated in Table II.

A comparison of the data in Table II indicates that the ethane has undergone significant endothermic cracking and has thus moderated the Scorch Zone cracking severity. The ethane decomposition to all products is approximately 58%. The ethane cracking product mole selectivity to $C_2H_4$ is approximately 78% of the total product with the remaining products from ethane consisting essentially of $C_2H_2$ and $H_2$.

These examples illustrate several important facets of the invention. The feedstock is injected so as to give good atomization and mixing with the gaseous combustion products, thus causing the total mixture to reach thermal equilibrium quickly and minimizing the extent of the Scorch Zone. As far as possible, flashing of the feedstock is encouraged to aid the atomization and mixing. A shroud fluid is also injected in the region of the Scorch Zone to moderate the very severe cracking in the Scorch Zone. The shroud fluid is used in relatively small quantities, but is fed in a very localized area where it can have the most benefit, and thus improves the yield pattern to a degree disproportionate to the cost of its use. In addition to thermal effects, the shroud fluid contains compounds which have a chemical moderating effect on the reactions in the Scorch Zone.

TABEL II

| DEMONSTRATION UNIT-NAPHTHA TESTS WITH ETHANE IN THE INJECTOR ANNULUS | | |
|---|---|---|
| RUN NOS. | RUN 1 NATH-THA ONLY | RUN 2 NAPHTHA PLUS ETHANE IN ANNULUS |
| Naphtha + Ethane (lb./hr.) | 1946 | 1953 |
| Ethane Annulus Flow (lb./hr). | 0 | 150 |
| Steam Annulus Flow (lb./hr.) | 200 | 200 |
| Combustion Gas Flow (lb./hr.) | 3094 | 3124 |
| Combustion Product Temp. (°C.) | 2187 | 2156 |
| Naphtha Feed Temp. (°C.) | 241 | 240 |
| Yields (lb./100 lb. cracking feedstock) | | |
| $H_2$ | 1.44 | 1.78 |
| $CH_4$ | 10.04 | 10.22 |
| $C_2H_2$ | 2.97 | 3.49 |
| $C_2H_4$ | 27.98 | 28.72 |
| $C_2H_6$ | 2.44 | 5.47 |
| $C_3H_6$ | 14.61 | 9.15 |
| $C_4H_6$ | 4.56 | 5.5 |
| $C_4H_8$ | 4.47 | 3.2 |

We claim:

1. An Advanced Cracking Reactor process wherein fuel is oxidized in a combustion zone to produce combustion gases having temperatures in the range of from about 1200° C. to 2400° C. comprising passing a stream comprising the combustion gases or an admixture of the combustion gases and steam to a Scorch Zone wherein a feedstock of shroud fluid and feedstock liquid mixes and impinges with said stream to produce an admixture, passing said admixture through a throat wherein the velocity of the admixture is increased, and thereafter moving said admixture more rapidly into a reaction zone wherein cracking occurs and the effluent from this zone is quenched, wherein the shroud fluid comprises hydrogen whereby the production of lower boiling species is reduced.

2. An Advanced Cracking Reactor process wherein fuel is oxidized in a combustion zone to produce combustion gases having temperatures in the range of from about 1200° C. to 2400° C. comprising passing a stream comprising the combustion gases or an admixture of the combustion gases and steam to a Scorch Zone wherein a feedstock of shroud fluid and feedstock liquid mixes and impinges with said stream to produce an admixture, passing said admixture through a throat wherein the velocity of the admixture is increased, and thereafter moving said admixture more rapidly into a reaction zone wherein cracking occurs and the effluent from this zone is quenched, wherein the shroud fluid comprises methane, ethane or propane whereby the production of lower boiling species is reduced.

* * * * *